US006114030A

United States Patent [19]

Westfal et al.

[11] Patent Number: 6,114,030

[45] **Date of Patent: *Sep. 5, 2000**

[54] RECORDING MATERIAL FOR THE INK JET PRINTING PROCESS

[75] Inventors: Horst Westfal, Belm; Andreas Diekmann, Hagen; Sonja Lönker, Wallenhorst, all of Germany

[73] Assignee: Felix Schoeller jr. Foto- und Speczialpapier GmbH & Co. KG, Osanabruck, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/715,036

[22] Filed: Sep. 17, 1996

[30] Foreign Application Priority Data

Sep. 21, 1995 [DE] Germany ..... 195 35 072

[51] Int. Cl.[7] ..... B41M 5/00

[52] U.S. Cl. ..... 428/331; 347/105; 428/195; 428/211; 428/329; 428/478.8

[58] Field of Search ..... 428/195, 478.2, 428/478.8, 328, 331, 211, 329; 347/105

[56] References Cited

U.S. PATENT DOCUMENTS

| | | | |
|---|---|---|---|
| 4,474,847 | 10/1984 | Schröder et al. . | |
| 4,946,741 | 8/1990 | Aono et al. . | |
| 4,976,997 | 12/1990 | Stockel et al. | 427/380 |
| 5,045,432 | 9/1991 | West et al. | 430/278 |

FOREIGN PATENT DOCUMENTS

| | | |
|---|---|---|
| 0 445 327 A1 | 9/1991 | European Pat. Off. . |
| 0 636 489 A1 | 2/1995 | European Pat. Off. . |
| WO 94/20303 | 9/1994 | WIPO . |

OTHER PUBLICATIONS

Abstract of JP 06340165 A, Dec. 13, 1994.

*Primary Examiner*—Pamela R. Schwartz
*Attorney, Agent, or Firm*—Norris, McLaughlin & Marcus, P.A.

[57] ABSTRACT

The invention relates to a recording material for the ink jet printing process. The recording material is characterized by a good smudgeproofness, image sharpness and color density, combined with only very low color transfer.

The ink receiving layer comprises a pigment and a carboxyl group-modified gelatin.

6 Claims, No Drawings

RECORDING MATERIAL FOR THE INK JET PRINTING PROCESS

The invention relates to a recording material for the multicolour ink jet printing process.

In the ink jet process droplets of a recording fluid are applied to the surface of the support material by means of various techniques.

There are basically two different processes for generating the droplets.

In the continuous droplet generation method a constant droplet stream is expelled under high pressure from the nozzle. The droplets not required for producing the image are returned to the ink reservoir by various methods.

In the drop-on-demand method an ink droplet is generated only on demand at the points where the image is to be created.

By means of a digital electronic control system it is possible to print images with very high resolution directly from electronic data.

The recording material has to satisfy stringent requirements. The most important requirements include:

high resolution,
high colour density,
high light fastness,
good smudgeproofness,
good waterproofness,
good wet-rub-off fastness,
high ink absorbing capacity, and
universal applicability.

These requirements are to some extent contradictory. In the majority of ink jet printers and various inks that are used, properties such as smudgeproofness and colour density are very difficult to harmonise. Also, the requirements for high resolution and smudgeproofness mutually conflict.

A recording material for the multicolour ink jet printing process generally consists of a support and a receiving layer arranged thereon. Materials such as paper and films are suitable supports. The absorption layer generally consists of a binder/pigment mixture.

The pigments increase the whiteness of the support material and lead to a better retention of the dyes on the surface of the sheet. A high pigment concentration leads to greater porosity (DE-PS 30 24 205) and thus to a good smudgeproofness. At the same time however dyes from the ink will also penetrate into the interior of the recording material and thereby adversely affect the colour density of the image.

Suitable binders for the absorption layers are for example gelatin, polyvinyl alcohol, polyvinyl pyrrolidone, starch and acrylates.

DE-PS 22 34 823 describes a paper coated with gelatin for ink jet printing. The gelatin coating is intended to improve the stability against wiping and the resolution. A disadvantage is that the applied image characters are not sufficiently smudgeproofness within the desired short time, but only after more than 10 seconds. A further disadvantage is the long drying time, which in the case of gelatin layers is generally more than 15 minutes.

The Japanese laid-open Patent Application JP 61-261 089 describes a mixture of polyvinyl alcohol, polyvinyl pyrrolidone and a cationic resin as binder in the receiving layer. This mixture is said to ensure a rapid drying and a high image sharpness. However, the wet-rub-off fastness of this binder mixture is poor.

The object of the present invention is accordingly to produce a recording material for the ink jet printing process that does not have the specified disadvantages and that is characterised in particular by a simple layer structure and high ink absorbing capacity, combined with high colour density and good smudgeproofness. In addition the recording material should as far as possible be usable for all types of printers and inks.

This objective is achieved by a recording material consisting of a support and a gelatin-containing and pigment-containing ink receiving layer, the said ink receiving layer containing a carbonyl-modified gelatin.

In a preferred embodiment of the invention a gelatin modified with maleic or phthalic anhydride, but in particular a gelatin modified with succinic anhydride, may be used. An acid-digested pig's skin gelatin is particularly preferred. The remaining amount of free amino groups in the gelatin according to the invention is 1 to 50 mol. %, preferably 2 to 30 mol. % and, in a particularly preferred embodiment, 2 to 20 mol. %.

The proportion of gelatin is between 95% by wt. and 30% by wt., in a preferred embodiment between 90% by wt. and 70% by wt., based on the solids content of the ink receiving layer.

It was surprising that the use of a gelatin without another binder produced such a short drying time and high colour density, especially as the sole use of gelatin according to the prior art was not expected to give such results.

In a preferred embodiment of the invention a colloidal, aluminium-modified silicic acid is used as pigment.

The proportion of the pigment is between 5% by wt. and 70% by wt., in a preferred embodiment between 10% by wt. and 30% by wt., based on the solids content.

In addition to the modified silicic acid, other inorganic and organic pigments such as $CaCO_3$, $TiO_2$, $BaSO_4$, polymethyl methacrylate and polystyrene may also be used as pigment.

In a further modification of the invention a dye-fixing agent is used, a cationic dicyandiamide copolymer having been found to be particularly suitable.

Further constituents of the receiving layer may include hardeners (chrome alum, TAF/formaldehyde), wetting agents, dye-fixing agents and other auxiliaries.

The coating weight of the receiving layer is 1 g to 15 g. In a preferred embodiment it is 2 g to 7 g.

The aqueous coating material may vary within the following amounts by weight:

| | % by wt. |
|---|---|
| Gelatin | 28.50–90.25 |
| Aluminium-modified silicic acid | 3.04–44.27 |
| Auxiliaries | 0.00–10.00 |
| Water | Remainder to 100.0 |

The coating material can be applied using all conventional coating and metering processes, such as roller coating, engraving or nip processes and air brushing or blade knife metering.

The support material is preferably a paper coated on both sides with a synthetic resin and having a basis weight of 50 to 250 g/m$^2$. Polyolefins or polyesters for example are used as synthetic resin. The coating weight of the synthetic resin coating is at least 5 g/m$^2$ and the coating may additionally also contain pigments, dyes and other auxiliaries. An uncoated or coated base paper is however also suitable as support material.

The following examples are intended to illustrate the invention in more detail; all figures are based on weight.

EXAMPLES

The front side of a polyethylene-coated base paper was coated with the following coating materials:

TABLE 1

| Constituents | B1 | B2 | B3 | B4 | B5 | B6 |
|---|---|---|---|---|---|---|
| Demineralised water | 10.70 | 10.70 | 7.55 | 4.35 | 13.20 | 8.70 |
| Modified gelatin 1), 20% | 66.50 | 66.50 | 76.00 | 85.50 | 68.00 | 66.50 |
| Al-modified silicic acid 2), 30% | 19.00 | 19.00 | 12.65 | 6.35 | 11.35 | 19.00 |
| Cat. dicyandiamide copolymer 3), 30% | — | — | — | — | — | 2.00 |
| Wetting agent, 10% in water | 0.80 | 0.80 | 0.80 | 0.80 | 0.80 | 0.80 |
| Butanol | 3.00 | 3.00 | 3.00 | 3.00 | 3.00 | 3.00 |
| Citric acid, 10% in water | — | — | — | — | 0.35 | — |
| Chrome alum 10% in water | — | — | — | — | 1.65 | — |
| TAF/formaldehyde 4), 2% | — | — | — | — | 1.65 | — |
| Coating weight g/m$^2$ | 4.60 | 11.20 | 4.60 | 4.60 | 5.00 | 4.60 |

1) Gelatin 71793, DGF Stoess
2) Ludox ® AM - Al-modified silicic acid (DuPont)
3) Protefix ® WFN, Protex-Extrosa GmbH
4) TAF - 1,3,5-triacryloyl-hexahydro-s-triazine Experimental Conditions drying temperature: 100° C.

drying time: 25–60 seconds knife: "40"

A base paper coated on both sides with polyethylene and with a basis weight of 150 g/m$^2$ served as substrate. The back of the base paper was coated with a LDPE (low density polyethylene) containing 0.6% by wt. of optical brightener. The coating weight was 22 g/m$^2$.

The front side was likewise coated with a LDPE. The front side coating also contained:

0.95% by wt. of optical brightener,

10% by wt. of titanium dioxide,

4% by wt. of lubricant, 10.8% by wt. of a blue master batch (10% Ultramarine, 90% LDPE).

The coating weight was 19 g/m$^2$.

The front side of the polyethylene-coated support material exhibited the following colorimetric values:

L=93.45 a=−0.35 b=−4.10

Comparison Examples V1

TABLE 2

| Constituents | V1a | V1b | V1c |
|---|---|---|---|
| Demineralised water | 17.00 | 15.65 | 4.35 |
| Gelatin 220 g Bloom 20% | 66.50 | — | 85.50 |
| Gelatin 280 g Bloom 20% | — | 70.00 | — |
| Al-modified silicic acid 30% | — | — | 6.35 |
| Wetting agent 10% | 0.50 | 0.50 | 0.50 |
| Alcohol/water mixture 50% | 10.00 | 10.00 | 3.00 |
| Citric acid 10% | 0.35 | 0.35 | — |
| Chrome alum 10% | 1.75 | 1.75 | — |
| TAF/formaldehyde 2% | 1.75 | 1.75 | — |
| Cat. dicyandiamide copolymer 30% | 2.35 | — | — |
| Coating weight g/m$^2$ | 4.50 | 4.00 | 4.70 |

The gelatin with a gelatin strength of 220 g Bloom is a normal, acid digested bone gelatin.

The gelatin with a gelatin strength of 280 g Bloom is a normal, unmodified pig's skin gelatin.

The experimental conditions are similar to those of Examples B1–B6.

Comparison Example V2

A commercially available ink jet paper with a gloss surface manufactured by Hewlett Packard served as further comparison.

Testing of the recording material obtained according to Example B1–B6 and comparison example V1a–V1c, V2.

The recording material was printed with a commercially available Hewlett Packard Ink Jet colour printer, HP550C, and the corresponding inks.

The printed images were tested for smudgeproofness, colour density, image sharpness, colour transfer and gloss The results are summarised in Tables 3–5.

1. Smudgeproofness:

The stability against wiping was tested by rubbing the printed image with a white cloth. This test was carried out individually for each colour.

"+"—no colour residues detectable on the cloth

"−"—colour residues detectable.

2. Colour Density:

The colour density was measured with a Gretag densitometer for the colours cyan, magenta, yellow and black.

3. Image Sharpness:

The image sharpness was evaluated visually and graded 1–5 (very good–poor).

4. Colour Transfer:

To test the colour transfer the printed image was covered with a PTS base paper and weighted for 24 hours with a 10 kg weight. The colour transfer from the ink receiving layer to the PTS base paper was evaluated visually and graded 1–5. A score of 1 means no colour transfer, while a score of 5 denotes a very pronounced colour transfer. The colours that are involved in the transfer are also specified.

5. Gloss:

The gloss was measured with a three engle gloss measuring device manufactured by Dr. Lange, at a 60° measurement angle.

Results of the smudgeproofness test of Examples B1–B6 and Comparison examples V1–V2.

TABLE 3

| | Cyan | Magenta | Yellow | Black |
|---|---|---|---|---|
| B1 | + | + | + | + |
| B2 | + | + | + | + |
| B3 | + | + | − | + |
| B4 | + | + | + | + |
| B5 | + | + | + | + |
| B6 | + | + | + | + |
| V1a | − | − | − | + |
| V1b | − | − | − | − |
| V1c | − | − | − | − |
| V2 | − | − | − | − |

+ = good
− = poor

Results of the density measurements of Examples B1–B6 and Comparison examples V1–V2.

TABLE 4

| | Cyan | Magenta | Yellow | Black |
|---|---|---|---|---|
| B1 | 2.09 | 1.25 | 1.41 | 1.93 |
| B2 | 2.07 | 1.21 | 1.39 | 1.90 |
| B3 | 2.06 | 1.24 | 1.41 | 1.89 |
| B4 | 2.06 | 1.24 | 1.37 | 1.90 |
| B5 | 2.06 | 1.23 | 1.38 | 1.91 |
| B6 | 2.07 | 1.25 | 1.41 | 1.90 |
| V1a | 2.03 | 1.18 | 1.29 | 1.86 |
| V1b | 1.94 | 1.17 | 1.31 | 1.79 |
| V1c | 2.00 | 1.21 | 1.33 | 1.80 |
| V2 | 2.10 | 1.41 | 1.39 | 1.91 |

Results of the tests for image sharpness, colour transfer and gloss of Examples B1–B6 and Comparison examples V1–V2.

TABLE 5

| | Image sharpness | Color transfer | Gloss 60 |
|---|---|---|---|
| B1 | 2 | 1 | 72.0 |
| B2 | 2 | 1 | 80.6 |
| B3 | 2 | 1 | 67.5 |
| B4 | 2 | 3 MC | 68.5 |
| B5 | 2 | 2 MC | 70.1 |

TABLE 5-continued

| | Image sharpness | Color transfer | Gloss 60 |
|---|---|---|---|
| B6 | 2 | 1 | 68.0 |
| V1a | 4 | 4 C, M, Y, MC | 72.1 |
| V1b | 2 | 5 C, M, Y, MC | 71.5 |
| V1c | 4 | 4 C, M, Y, MC | 68.8 |
| V2 | 2 | 1 | 79.9 |

C Cyan is transferred
M Magenta is transferred
G Yellow is transferred
MC Mixed colors are transferred.

The examples show that, compared to the comparison examples, it was possible to improve the smudgeproofness, image sharpness and colour density and to even very considerably improve the colour transfer.

What is claimed is:

1. Recording material for the ink jet printing process comprising a paper support and a gelatin-containing and pigment-containing ink receiving layer, wherein the ink receiving layer comprises a succinic anhydride-modified gelatin with a residual content of free amino groups of up to 50 mol. %, and wherein the proportion of the pigment is between 5% and 70% by weight, based on the solids content of the ink-receiving layer.

2. Recording material according to claim 1, characterised in that the pigment consists of colloidal, aluminium-modified silicic acid.

3. Recording material according to claim 1, characterised in that the pigment to gelatin ratio is 1:0.4 to 1:20.

4. Recording material according to claim 1, characterised in that the ink receiving layer comprises a cationic dicyandiamide-copolymer.

5. A recording material according to claim 1, wherein the paper support is coated on both sides with a synthetic resin and has a basis weight of 50 to 250 g/m$^2$.

6. In an ink jet printing process comprising the step of ink jet printing information onto a recording material, wherein the improvement comprises using as the recording material a recording material according to any one of claims 1 and 2–5.

* * * * *